US009424734B1

(12) United States Patent
Hagi et al.

(10) Patent No.: US 9,424,734 B1
(45) Date of Patent: Aug. 23, 2016

(54) DEVICE TO MONITOR DISTANCE BETWEEN PEOPLE

(71) Applicant: KING ABDULAZIZ UNIVERSITY, Jeddah (SA)

(72) Inventors: Sarah Hagi, Jeddah (SA); Nazeeh Alothmany, Jeddah (SA); John G. Webster, Madison, WI (US); Adam Strebel, De Pere, WI (US); Jack Goss, Belgium, WI (US); Emily Carroll, Brookfield, WI (US); Michael Ouirk, Green Bay, WI (US); Tommy Zipp, Green Bay, WI (US); David Mott, Middleton, WI (US); Elliot Saldivar, Green Bay, WI (US); Justin Faanes, Green Bay, WI (US); Jesse Wang, Green Bay, WI (US)

(73) Assignee: KING ABDULAZIZ UNIVERSITY, Jeddah (SA)

( * ) Notice: Subject to any disclaimer, the term of this patent is extended or adjusted under 35 U.S.C. 154(b) by 0 days.

(21) Appl. No.: 14/958,906

(22) Filed: Dec. 3, 2015

(51) Int. Cl.
*G08B 21/00* (2006.01)
*G08B 21/18* (2006.01)

(52) U.S. Cl.
CPC ..... *G08B 21/182* (2013.01)

(58) Field of Classification Search
CPC ..... G08B 21/02; G08B 21/182; G08B 21/22
USPC ..... 340/686.6, 573.1, 567, 539.23, 309.16
See application file for complete search history.

(56) References Cited

U.S. PATENT DOCUMENTS

| | | | | |
|---|---|---|---|---|
| 8,102,261 | B2 * | 1/2012 | Wu | G01S 13/56 340/541 |
| 2007/0063851 | A1 * | 3/2007 | Addison | G08B 23/00 340/573.1 |
| 2007/0245612 | A1 * | 10/2007 | Tresenfeld | 40/665 |
| 2008/0218340 | A1 * | 9/2008 | Royer | G01S 13/56 340/567 |
| 2009/0125083 | A1 | 5/2009 | Maples | |

* cited by examiner

*Primary Examiner* — Phung Nguyen
(74) *Attorney, Agent, or Firm* — Richard C. Litman

(57) ABSTRACT

The device to monitor distance between people measures a pre-defined distance between a first person and other persons, and alerts the user when the pre-defined distance has been breached or violated for more than a pre-determined time. Intended to protect a first human from the deleterious effects of radiation (nuclear) associated with a second human, but useful in other circumstances, the device is designed to detect the presence of a first person within a protective radius of one to two meters of a second person by pairing the combination of one heat sensor with one distance sensor. In the event the first person is within that radius for the predetermined time, the device will alert the user of that circumstance. Alert feedback mechanisms can include an acoustic audible signal, a visible signal, a vibratory signal, or phone notification.

15 Claims, 7 Drawing Sheets

DEVICE TO MONITOR DISTANCE BETWEEN PEOPLE

BACKGROUND OF THE INVENTION

1. Field of the Invention

The present invention relates generally to proximity sensor circuits, and particularly to a device to monitor distance between people that provides for measuring a pre-defined distance between a first person and other persons, the device alerting the user when the pre-defined distance has been breached or violated for more than a pre-determined time.

2. Description of the Related Art

After a patient who has been treated with therapeutic doses of radioactive iodine (I-131) is discharged, the radiation from the doses can be potentially harmful to those in close proximity to the patient. Greatest concern is given to family members, individuals close to the patient, as well as health care professionals and the environment. It was found that those who are close to the patient should not exceed 5 mSv of cumulative radiation exposure per treatment episode.

The thyroid gland produces hormones that affect heart rate, blood pressure, body temperature, and weight. One in 92 men and women will be diagnosed with thyroid cancer during their lifetime. About 60,200 new cases of thyroid cancer will be diagnosed in 2013, with an estimated 1,850 deaths. Of the estimated 60,200 new cases of thyroid cancer, it is estimated that 45,310 will be women, and 14,910 will be men. The median age for thyroid cancer is 50 years of age.

Another common thyroid disorder, hyperthyroidism, occurs when the patient has excessive amounts of thyroid hormones due to several different diseases, such as Graves' disease, toxic multinodular goiter, or toxic adenoma. Common symptoms of hyperthyroidism include excessive sweating, heat intolerance, increased bowel movements, tremor, nervousness, rapid heart rate, weight loss, fatigue and irregular menstrual flow. Hyperthyroidism is much more common than thyroid cancer, with approximately 2% of women and 0.2% of men experiencing cases of hyperthyroidism at some point in their lifetime.

Doses of I-131 as a method of systematic radiation therapy has successfully treated hyperthyroidism and thyroid cancer for more than 60 years. Radioiodine is the treatment of choice for radiation therapy in the United States, United Kingdom, and Canada because it is relatively inexpensive and very effective compared to other treatments. Radioactive iodine works well for thyroid treatment because the thyroid cells naturally take up iodine, allowing the radioactive iodine to damage the DNA of the cancerous cells.

One of the risks of radioactive iodine therapy is that the patient becomes temporarily radioactive after treatment. While most of the radioactive iodine is excreted through urine, the patient can radiate gamma rays from the decaying I-131. These gamma rays can be particularly harmful for pregnant women and children standing near the iodine therapy patient due to their higher risk of developing cancer.

The chance for developing fatal cancer due to exposure to radiation increases by 5% per Sievert of radiation accumulated, and the odds of developing cancer are 2 to 3 times higher for children. Although the dosage of secondary radiation to other persons from radioiodine therapy patients is to the order of micro Sieverts per hour, patients must be sure that exposure to children and pregnant women is minimized due to their increased chance of developing cancer after exposure to radiation.

In order to minimize secondary radiation to other persons, doctors set forth strict guidelines for patient behavior following treatment. Patients are instructed to stay one meter away from persons at home and two meters away from someone if they are near them for an extended period of time. Also, it is recommended that children under two-years of age are cared for in a separate household if the parent received radioiodine because children often require physical attention, which the parent cannot give following treatment.

Patients must follow more extensive guidelines regarding public interactions, including avoiding public transportation, avoiding work if it is necessary to stand or sit near coworkers for an extended time, and disposing of tissues or other waste items properly. The timeframe that a patient must follow these guidelines varies from 24 hours to six weeks, depending on the dosage of radioactive iodine. For up to six weeks, patients should be conscious of their distance to others within the aforementioned timeframe, especially with respect to children and pregnant women. Nevertheless, patients may inadvertently come into proximity with persons at high risk of adverse consequences from secondary radiation, or inadvertently remain in such proximity for too long a period of time.

Thus, a device to monitor distance between people solving the aforementioned problems is desired.

SUMMARY OF THE INVENTION

The device to monitor distance between people measures a pre-defined distance between a first person and other persons, and alerts the user when the pre-defined distance has been breached or violated for more than a pre-determined time. Intended to protect a first human from the deleterious effects of radiation (nuclear) associated with a second human, but useful in other circumstances, the device is designed to detect the presence of a first person within a protective radius of one to two meters of a second person by pairing the combination of one heat sensor with one distance sensor. In the event the first person is within that radius for the predetermined time, the device will alert the user of that circumstance. Alert feedback mechanisms can include an acoustic audible signal, a visionary signal, a vibratory signal, or phone notification.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

The device to monitor distance between people measures a pre-defined distance between a first person and other persons, and alerts the user when the pre-defined distance has been breached or violated for more than a pre-determined time. Intended to protect a first human from the deleterious effects of radiation (nuclear) associated with a second human, but useful in other circumstances, the system is designed to detect the presence of a first person within a protective radius of one to two meters of a second person by pairing the combination of one heat sensor with one distance sensor. In the event that the first person is within that radius for the predetermined time, the device will alert the user of that circumstance. Alert feedback mechanisms can include an acoustic audible signal, e.g., a buzzer B (shown in FIG. 1), a visible signal, e.g., a light or an LED, a vibratory signal, or phone notification.

Figure 1:
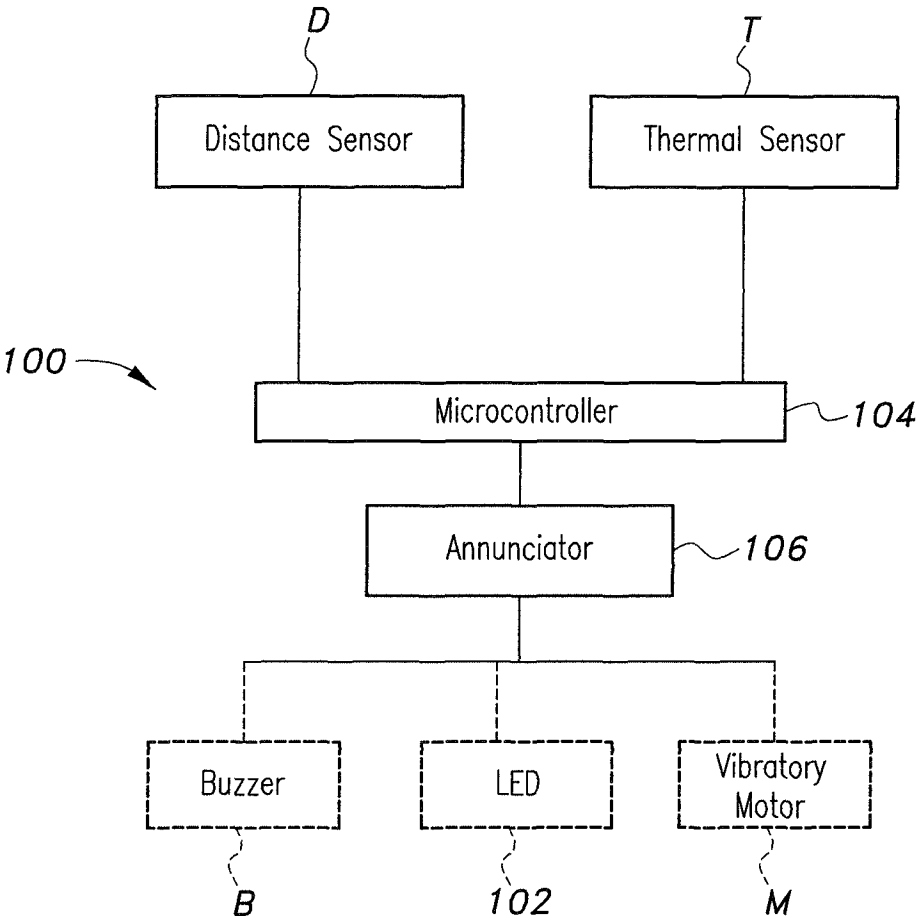
FIG. 1 is a pictorial diagram of a circuit for a device to monitor distance between people according to the present invention.
Figure 2:
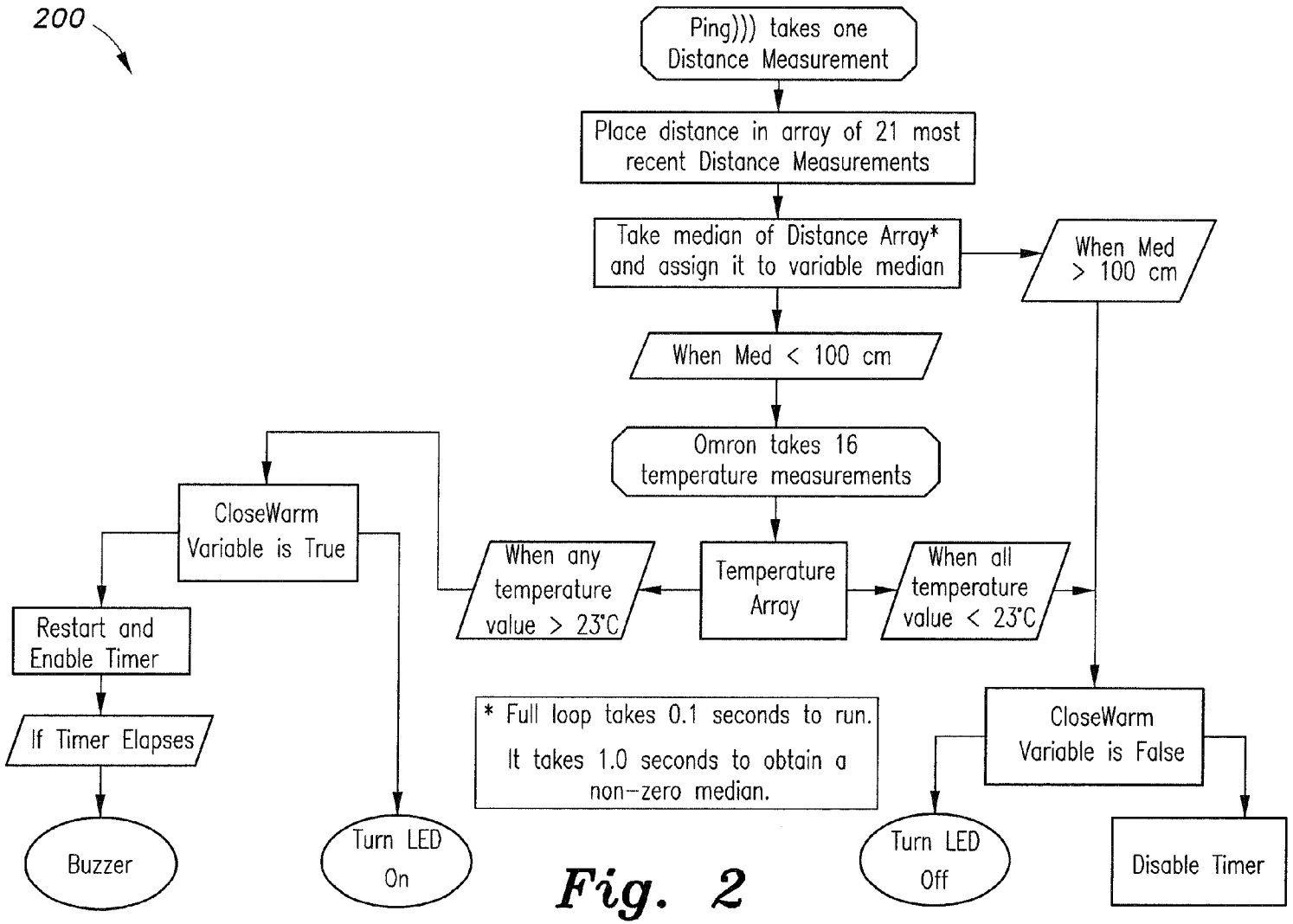
FIG. 2 is a flowchart of the software code for a controller of a device to monitor distance between people a according to the present invention.

As shown in FIG. 1, a proximity sensor circuit 100 includes a microcomputer connected to peripherals, which include a thermal sensor T (such as an Omron DST MEMS Thermal Sensor) T and a distance sensor D (such as a PING)))™ ultrasound Distance Sensor made by Parallax, Inc.). The circuit 100 also includes at least one annunciator 106, which generates an alarm or alert (which may be audible, visible, or tactile) under certain conditions, as described herein. The annunciator may be the aforementioned buzzer B, light or LED 102, or a vibratory motor M. FIG. 2 shows a flowchart of exemplary microcontroller software code 200 implemented by the microcomputer 104, and Table 1 shows representative pseudocode. A prototype of the circuit was made using an Arduino® (Arduino is a registered trademark of Arduino S.R.L. of Italy) circuit board, which includes an Atmel ATmega 328P microcontroller. However, it will be obvious that the circuit may be implemented using other microcontrollers, e.g., a BASIC Stamp microcontroller, a PICKAXE microcontroller, etc.

TABLE 1

Representative Microcontroller Pseudocode

| Step Number | Function |
|---|---|
| 1 | PING))) ™ takes one Distance Measurement |
| 2 | Place distance in array of 21 most recent Distance Measurements. |
| 3 | Take median of Distance Array*and assign it to variable med |
| 4 | If med < 100 cm<br>{ Omron takes 16 Temperature Measurements and places them in the Temperature Array;<br>If all temperature values < 23° C.;<br>{ Set CloseWarm = False;<br>Turn LED off;<br>Disable Timer;<br>}<br>If any temperature value > 23° C.;<br>{ Set CloseWarm = True;<br>Restart and Enable Timer;<br>Turn LED on;<br>If Timer Elapses;<br>{ Sound Buzzer;<br>}<br>}<br>} |

TABLE 1-continued

Representative Microcontroller Pseudocode

| Step Number | Function |
|---|---|
| 5 | If med > 100 cm;<br>{Set CloseWarm = False;<br>Turn LED off;<br>Disable Timer;<br>} |

Figure 3:
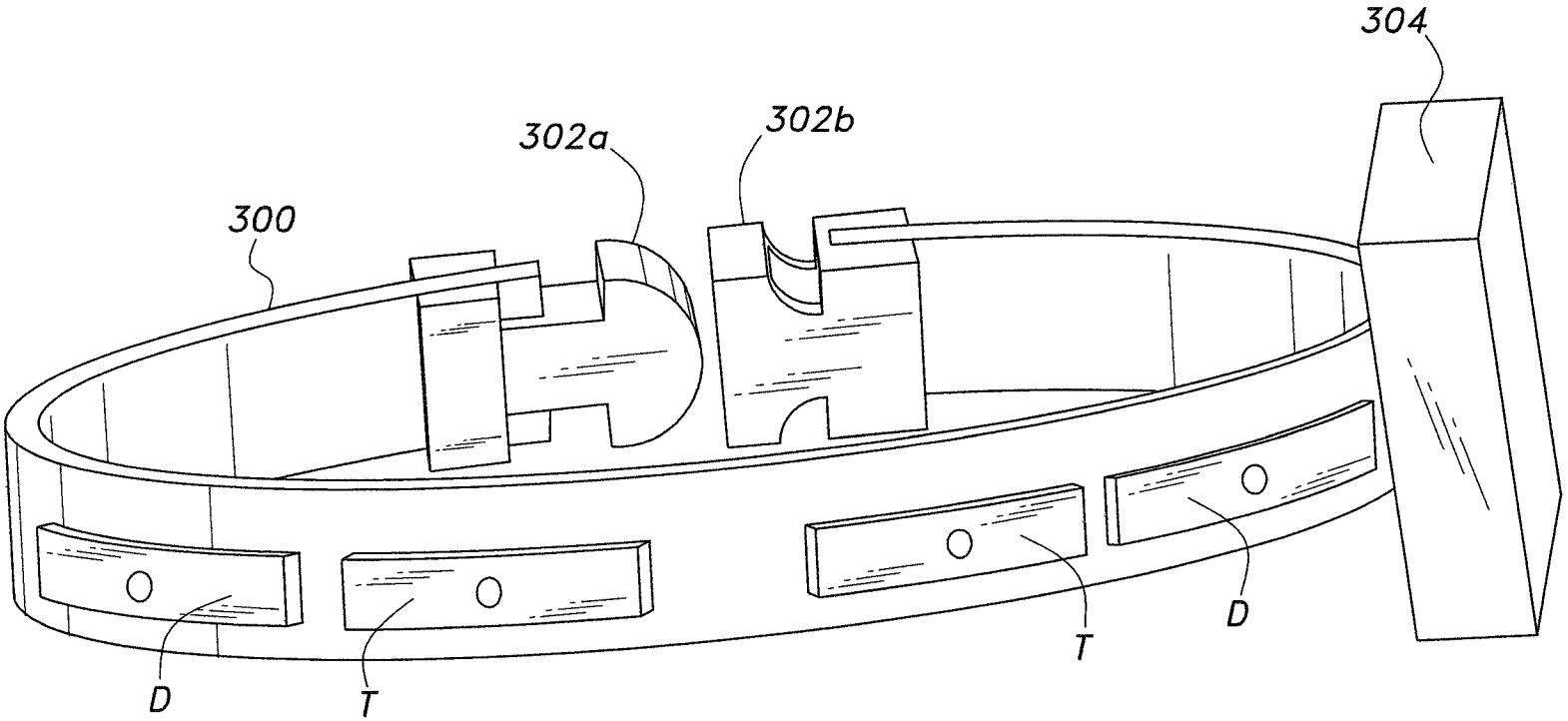
FIG. 3 is a perspective view of an embodiment of the device to monitor distance between people according to the present invention implemented in a belt.

As shown in FIG. 3, the device to monitor distance between people may include a mounting belt 300 having a buckle insert 302*a*, which fits into a buckle receiver 302*b* to latch and secure the device around a user's waist. In this embodiment, the distance sensor D and the thermal sensor T are disposed on a front portion of the belt 300 left to right in D/T pairs, i.e., a first D/T pair of sensors is disposed on a front left portion of mounting belt 300 and a second D/T pair of sensors is disposed on a front right portion of the mounting belt 300. The thermal sensors T are placed 2.5 cm from the center, while the MaxBotix® MB1200 XL-MaxSonar®-EZ0™ (alternative to the Parallax PING)))™ distance sensors) distance sensors are placed outside, i.e., thermal sensors T are disposed on either side 2.5 cm from a center portion of the belt, the center portion of the belt being in angular alignment with an imaginary midline extending forward from a navel of the wearer, the imaginary midline dividing a body of the wearer exactly in left and right side. Each distance sensor D is placed on the same side of the wearer's body as the corresponding thermal sensor T and more distal from the imaginary midline than the thermal sensor T. This minimizes any blind spots in the center of the belt, since the Omron D6T8L06 has the limiting field of view of 63°.

In order to attach these sensors securely to the belt 300, sensor housing units were 3D printed to meet the attachment requirements. A plastic housing 304 is attached to a side portion of belt 300, the housing 304 enclosing boards containing the circuit 100 of the device. Furthermore, the housing 304 also contains a power switch, LED indicators, and a connection port. The connection port is connected to the microcontroller 104 and allows for calibration and data collection, when necessary. This device may have three ways of alerting the user and surrounding people of radiation exposure: an LED strip, an LED indicator, and a vibrational motor. The LED strip is placed around the belt 300. Both the LED strip and the indicator will start flashing when detection is made. A small vibration motor is located inside the plastic housing 304, and similar to a phone buzzer, the user can have tactile feedback when the signal is present. The final weight of the device is about 2 kg.

Referring to FIG. 1, instead of a belt, the sensors could be placed on a cap or on a lanyard around the neck facing forward from the chest. One heat sensor T and one distance sensor D are paired together to perform detection of a second human. Additional sensors could be placed elsewhere on the body to increase coverage. The output from the sensors is processed by the microcontroller 104. The microcontroller 104 may send outgoing signals to a dual-feedback mechanism located on the patient's belt or elsewhere on the body. This dual-feedback mechanism includes a visual alert via LED 102 and an auditory alert via a small speaker B, e.g., a piezoelectric speaker. The LED 102 begins to flash when the sensors (combination of D and T) immediately detect a second human within one meter of the user, while the auditory alarm B sounds when the second human has remained in the one meter zone for more than ten seconds. An 85 dB piezo buzzer may be utilized as auditory alarm B and provides sufficient acoustic feedback for that purpose. Alternatively, different color lights (green, yellow, red) could indicate the danger level of a person that has been in the field of view for certain amounts of time. Alternatively, different beep rhythms, tones, and volumes could be used for different amounts of exposure time to radiation. The microcontroller 104 is the master and the thermal sensor T is the slave with the 7 bit address of 0x0A. As shown in FIG. 2, if any of the 16 temperature values from the 4×4 grid corresponding to the field of view of the thermal sensor T is above 23° C., the variable highTemp is true and the loop checking the thermal readings is broken.

If the median of the distance measurements is less than 100 cm and highTemp is true, then the variable close Warm is also true. If close Warm is true, the LED 102 is immediately turned on and the buzzer timer begins. This timer runs for 10 seconds before activating the buzzer signal and restarting. If close Warm becomes false because the median of the distances is above 100 cm or the temperature values are all below 23° C., the LED 102 is turned off and the timer for the buzzer is disabled. Multiple sensors and multiple measurements may also be helpful in determining if there are multiple people in the field of view. The proximity sensor circuit 100 is battery-powered, e.g., using two 9-volt batteries, and via the code logic, sensors, and alerts, informs the wearer if a second human is too close. The distance sensor D determines if the distance is less than 1 meter. The heat sensor T determines if the object is significantly warmer than ambient temperature. If both conditions are met, the patient (wearer of the device) receives an alarm.

Figure 4:
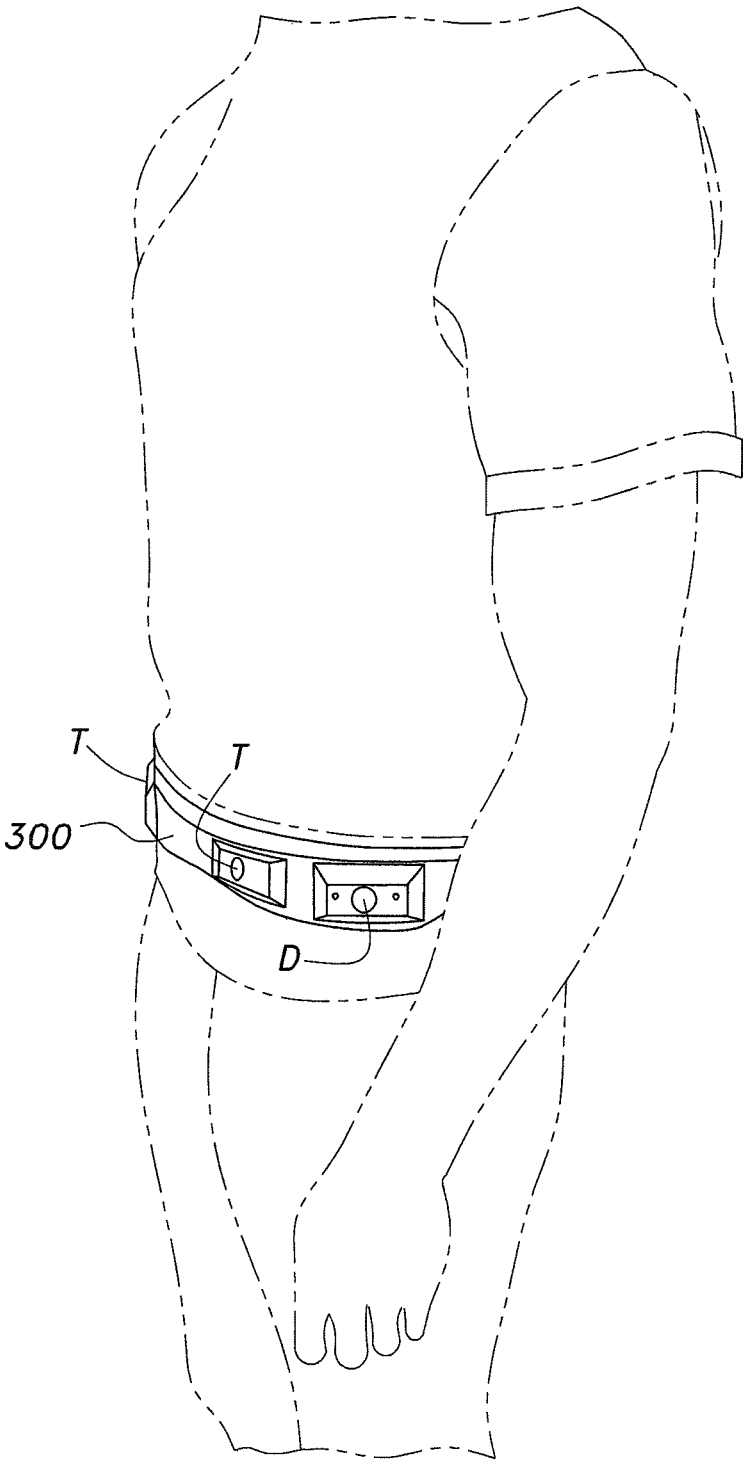
FIG. 4 is an environmental perspective view of the device to monitor distance between people of FIG. 3.
Figure 5:
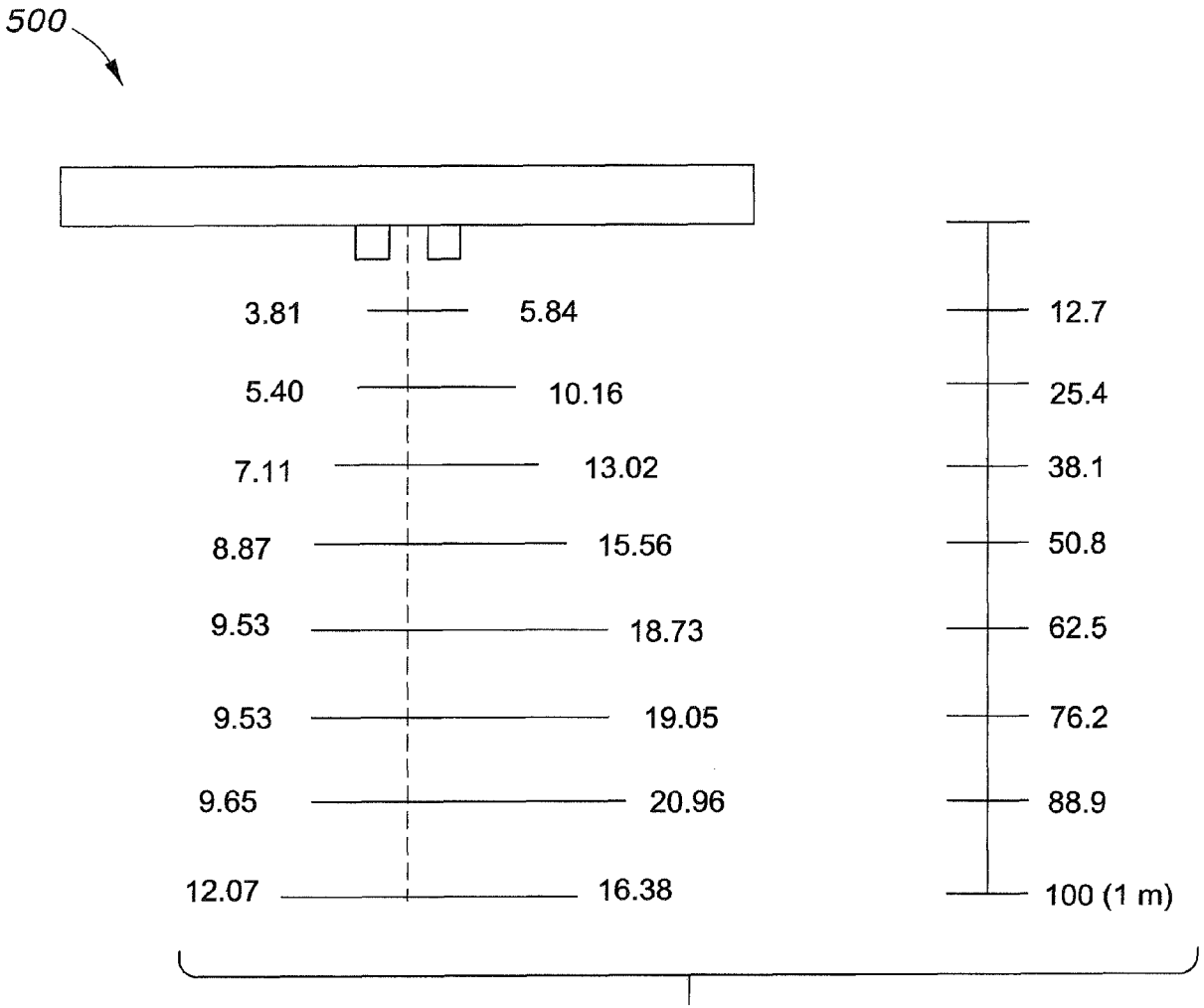
FIG. 5 is a chart showing horizontal viewing angles provided by sensors of the device to monitor distance between people according to the present invention.

FIG. 4 shows an exemplary device attached to a user. Nomogram 500 (shown in FIG. 5) relates the angular detection field of view with the distance of the object detected using the distance sensor D.

Figure 6:
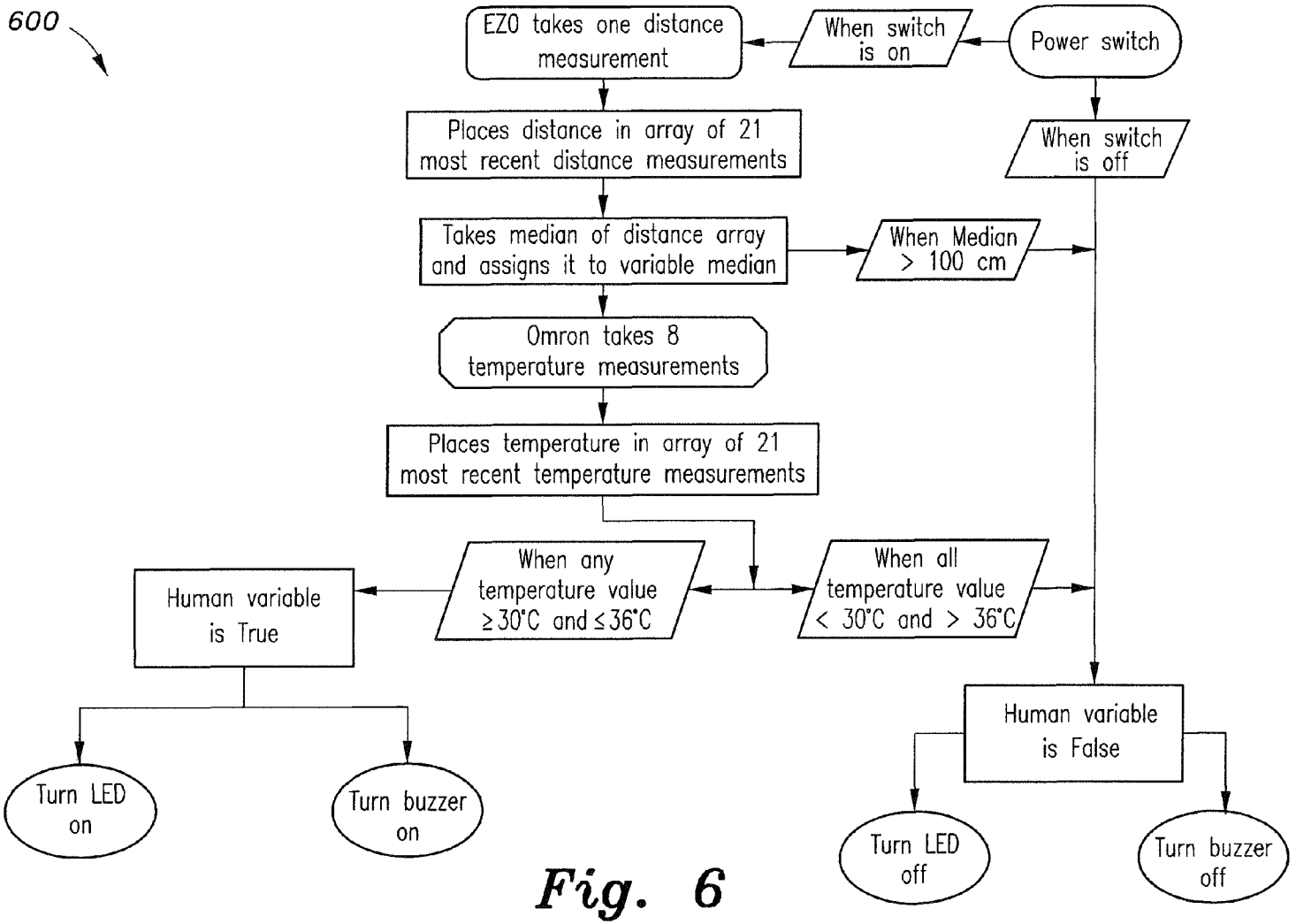
FIG. 6 is an alternative flowchart of the software code for a controller of a device to monitor distance between people according to the present invention

FIG. 6 shows a diagram of the logical flow 600 performed by code running on the microcomputer 104 in an alternative embodiment while using the MaxBotix® MB1200 XL-MaxSonar®-EZ0™ as the distance sensor D instead of the Parallax Ping))) sensor. Table 2 shows representative pseudocode 600 for the microcontroller programming. When the power switch is applied to the microcontroller 104, the microcontroller directs the EZ0 distance sensor D to collect a measurement. If the distance is below 1 m, the microcontroller 104 then triggers the thermal sensor T to collect temperature data. If the temperature is within the detection range of 30° C. to 36° C., the LED 102 and buzzer(s) B are triggered to alert the user. Otherwise, the LED 102 and buzzer B will turn off or remain off. This will be looped back to the distance sensor D to repeat the cycle. The logic flow is in a constant iteration pathway.

TABLE 2

Alternative Microcontroller Pseudocode

| Step Number | Function |
|---|---|
| 1 | If the power is turned on<br>EZ0 ™ takes one Distance Measurement; |
| 2 | Place distance in array of 21 most recent Distance Measurements; |
| 3 | Take median of Distance Array*and assign it to variable median |
| 4 | Omron takes 8 Temperature Measurements and places them in the Temperature Array of 21 most recent temperature measurements; |

TABLE 2-continued

Alternative Microcontroller Pseudocode

| Step Number | Function |
|---|---|
| | If all temperature values < 30° C. or > 36° C.<br>{ Set Human = False;<br>Turn LED off;<br>Turn Buzzer off;<br>} |
| | If any temperature value > 30° C. and ≤ 36° C.;<br>{ Set Human = True;<br>Turn LED on;<br>Turn Buzzer on;<br>} |
| 5 | If med > 100 cm<br>{Set Human = False;<br>Turn LED off;<br>Turn Buzzer off;<br>} |
| 6 | If the power is turned off<br>{Set Human = False;<br>Turn LED off;<br>Turn Buzzer off;<br>} |

Figure 7:
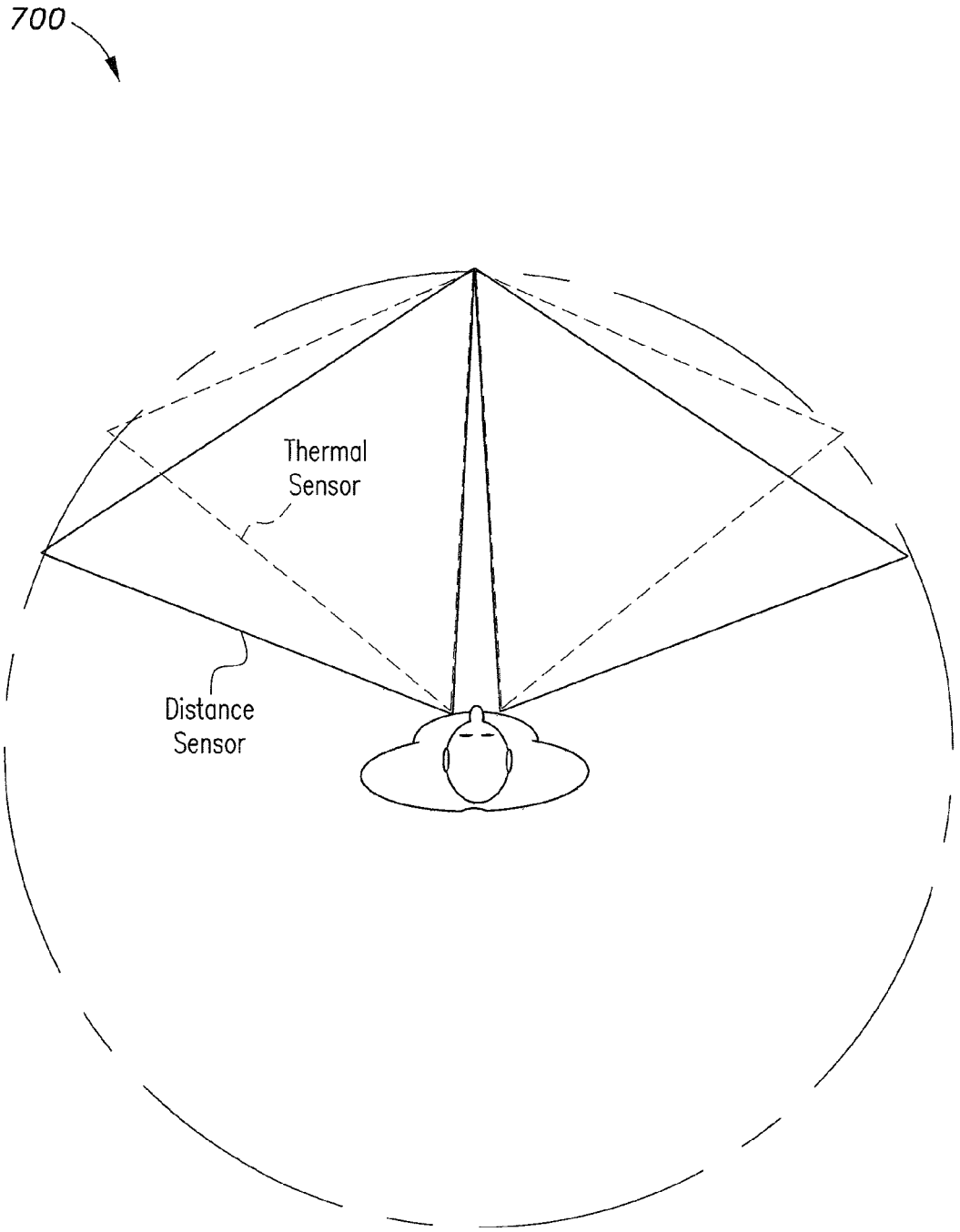
FIG. 7 is a schematic diagram showing the nominal viewing area of all four sensors of a device to monitor distance between people according to the present invention.

The detection field graph 700, shown in FIG. 7, reveals that the nominal viewing area of all four sensors combined is around 120°.

It is to be understood that the present invention is not limited to the embodiments described above, but encompasses any and all embodiments within the scope of the following claims.

We claim:

1. A wearable device to monitor distance between people, comprising:

a belt worn by a user;

a distance sensor;

a thermal sensor, wherein the thermal sensor is disposed a predetermined distance from a center portion of the belt, the center portion of the belt being in angular alignment with an imaginary midline extending forward from a navel of the user, the imaginary midline dividing a body of the user exactly into left and right side, further wherein the at least one distance sensor is on the same side of the wearer's body as the thermal sensor and more distal from the imaginary midline than the thermal sensor;

at least one annunciator; and a microcontroller connected to the distance sensor, the thermal sensor, and the at least one annunciator, the microcontroller having software stored and executable thereon, the software including:

means for determining when an object is within a predetermined distance from the distance sensor in response to signals received from the distance sensor;

means for determining whether the object is another person in response to signals from the thermal sensor corresponding to the object's temperature; and means for actuating the annunciator to generate an alert when the object is another person within the predetermined distance.

2. A wearable device to monitor distance between people, comprising:

a belt worn by a user;

a microcontroller circuit;

a housing, the microcontroller circuit being disposed inside the housing, the housing being releasably attached to the belt;

at least one distance sensor connected to the microcontroller circuit, the distance sensor being disposed on the belt;

at least one thermal sensor connected to the microcontroller circuit, the thermal sensor being disposed on the belt, wherein the at least one thermal sensor is disposed about 2.5 cm from a center portion of the belt, the center portion of the belt being in angular alignment with an imaginary midline extending forward from a navel of the wearer, the imaginary midline dividing a body of the wearer exactly into left and right side, further wherein the at least one distance sensor is on the same side of the wearer's body as the thermal sensor and more distal from the imaginary midline than the thermal sensor;

means using the microcontroller circuit for determining when a person is within a predetermined distance from the distance sensor;

means using the microcontroller circuit for alerting a wearer of the wearable device when the person is within the predetermined distance from the distance sensor for more than a predetermined time.

3. The wearable device according to claim 2, wherein said at least one distance sensor comprises two distance sensors and said at least one thermal sensor comprises two thermal sensors.

4. A proximity sensor circuit, comprising:

at least one distance sensor;

at least one thermal sensor focused in the same direction as the at least one distance sensor;

at least one annunciator; and a microcontroller connected to the at least one distance sensor, the at least one thermal sensor, and the at least one annunciator, the microcontroller having software stored and executable thereon, the software including:

means for determining when an object is within up to two meters from the at least one distance sensor in response to signals received from the distance sensor;

means for actuating the at least one thermal sensor to sense temperature when the object is within one meter of the at least one distance sensor;

means for determining whether the temperatures sensed by the at least one thermal sensor fall within ranges corresponding to a human being's body temperature; and means for actuating the annunciator to generate an alert when the object is within up to two meters from distance sensor and the temperatures sensed by the at least one thermal sensor fall within the ranges corresponding to the human being's body temperature.

5. The proximity sensor circuit according to claim 4, wherein said at least one distance sensor comprises an ultrasonic distance sensor.

6. The proximity sensor circuit according to claim 4, wherein said at least one thermal sensor comprises an infrared temperature sensor.

7. The proximity sensor circuit according to claim 4, wherein said at least one annunciator comprises an audible alert.

8. The proximity sensor circuit according to claim 4, wherein said at least one annunciator comprises a piezoelectric buzzer.

9. The proximity sensor circuit according to claim 4, wherein said at least one annunciator comprises a visible alert.

10. The proximity sensor circuit according to claim 4, wherein said at least one annunciator comprises an LED.

11. The proximity sensor circuit according to claim 4, wherein said at least one annunciator comprises a tactile alert.

12. The proximity sensor circuit according to claim 4, wherein said at least one annunciator comprises a vibratory motor.

13. The proximity sensor circuit according to claim 4, wherein said at least one distance sensor and said at least one thermal sensor are mounted on an object wearable by a first person, whereby the proximity sensor detects proximity of a second person to the first person when the wearable object is worn by the first person.

14. The proximity sensor circuit according to claim 4, wherein the software stored and executable on said microcontroller further includes means for delaying actuation of the annunciator for a time interval.

15. The proximity sensor circuit according to claim 4, wherein said at least one distance sensor, said at least one thermal sensor, said at least one annunciator, and said microcontroller are all mounted on an object wearable by a first person, whereby the proximity sensor is portable and detects proximity of a second person to the first person when the wearable object is worn by the first person.

* * * * *